US007185964B2

(12) United States Patent
Kanda et al.

(10) Patent No.: US 7,185,964 B2
(45) Date of Patent: Mar. 6, 2007

(54) PRINTING METHOD AND PRINTING APPARATUS

(75) Inventors: Hidehiko Kanda, Kanagawa (JP); Takeji Niikura, Kanagawa (JP); Tetsuya Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 353 days.

(21) Appl. No.: 10/784,262

(22) Filed: Feb. 24, 2004

(65) Prior Publication Data

US 2004/0165022 A1 Aug. 26, 2004

(30) Foreign Application Priority Data

Feb. 26, 2003 (JP) ..... 2003-049972
Jan. 23, 2004 (JP) ..... 2004-015521

(51) Int. Cl.
*B41J 2/205* (2006.01)

(52) U.S. Cl. ..... 347/15; 358/1.2

(58) Field of Classification Search ..... 347/43, 347/15, 41; 358/1.2, 1.9
See application file for complete search history.

(56) References Cited

U.S. PATENT DOCUMENTS 5,825,377 A 10/1998 Gotoh et al.
5,980,012 A 11/1999 Fujita et al.
6,145,950 A 11/2000 Ohtsuka et al.
6,196,661 B1 3/2001 Saito
6,203,133 B1 3/2001 Tanaka et al.
6,682,170 B2 * 1/2004 Hotomi et al. ..... 347/43
2002/0105557 A1 * 8/2002 Teshigawara et al. ..... 347/15
2002/0186277 A1 12/2002 Kanda et al.

FOREIGN PATENT DOCUMENTS

JP 9-46522 2/1997

* cited by examiner

*Primary Examiner*—Lamson Nguyen
(74) *Attorney, Agent, or Firm*—Fitzpatrick, Cella, Harper & Scinto

(57) ABSTRACT

A printing method and printing apparatus can print a high-quality image free from any visual graininess by reducing density unevenness and color unevenness. In printing by discharging ink from a printhead onto a printing medium, the printing apparatus executes either one of (A) a first printing operation mode in which one dot layout pattern is assigned to a plurality of pixels at the same gradation level and printing is done on the basis of the assigned dot layout pattern, or (B) a second printing operation mode in which plural types of dot layout patterns are assigned to a plurality of pixels at the same gradation level and printing is done on the basis of the assigned dot layout patterns.

14 Claims, 22 Drawing Sheets

FIG. 5

| QUANTIZATION LEVEL | NUMBER OF PRINTING DOTS | PIXEL DATA |
|---|---|---|
| 0 | 0 | · 0000 |
| 1 | 1 | · 0001<br>· 0010<br>· 0100<br>· 1000 |
| 2 | 2 | · 0011 · 1010<br>· 0101 · 1100<br>· 0110<br>· 1001 |
| 3 | 3 | · 0111<br>· 1011<br>· 1101<br>· 1110 |
| 4 | 4 | · 1111 |

FIG. 7A
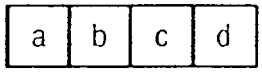
FIG. 7B
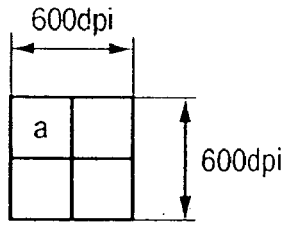
FIG. 7C
| QUANTIZATION LEVEL | DOT LAYOUT (INK DROPLET ADHERING POSITION) |
|---|---|
| 0 | |
| 1 | |
| 2 | |
| 3 | |
| 4 | |

FIG. 10A
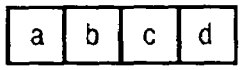
FIG. 10B
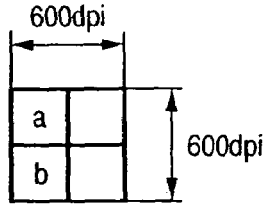
FIG. 10C
| QUANTIZATION LEVEL | DOT LAYOUT (INK DROPLET ADHERING POSITION) |
|---|---|
| 0 | |
| 1 | |
| 2 | |
| 3 | |
| 4 | |

FIG. 12

| | MAIN SCANNING SIZE OF PRINTING MEDIUM | DENSITY UNEVENNESS IN MAIN SCANNING DIRECTION AND SUB-SCANNING DIRECTION | GRAININESS |
|---|---|---|---|
| FIRST PRINTING OPERATION | 3 INCHES | ◎ | ○ |
| | 4 INCHES | ○ | ○ |
| | 5 INCHES | △ | ○ |
| | 6 INCHES | × | ○ |
| | 7 INCHES | × | ◎ |
| | 8 INCHES | ×× | ◎ |
| SECOND PRINTING OPERATION | 3 INCHES | ◎ | △ |
| | 4 INCHES | ○ | △ |
| | 5 INCHES | ○ | ○ |
| | 6 INCHES | ○ | ○ |
| | 7 INCHES | ○ | ○ |
| | 8 INCHES | ○ | ○ |

FIG. 14A
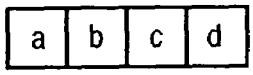
FIG. 14B
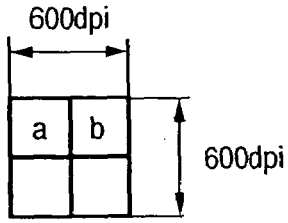
FIG. 14C
| QUANTIZATION LEVEL | DOT LAYOUT (INK DROPLET ADHERING POSITION) |
|---|---|
| 0 | |
| 1 | |
| 2 | |
| 3 | |
| 4 | |

FIG. 16

| | SUB-SCANNING SIZE OF PRINTING MEDIUM | DENSITY UNEVENNESS IN MAIN SCANNING DIRECTION AND SUB-SCANNING DIRECTION | GRAININESS |
|---|---|---|---|
| FIRST PRINTING OPERATION | 5 INCHES | ◎ | ○ |
| | 6 INCHES | ○ | ○ |
| | 7 INCHES | △ | ○ |
| | 8 INCHES | × | ○ |
| | 9 INCHES | × | ◎ |
| | 10 INCHES | ×× | ◎ |
| SECOND PRINTING OPERATION | 5 INCHES | ◎ | △ |
| | 6 INCHES | ○ | △ |
| | 7 INCHES | ○ | ○ |
| | 8 INCHES | ○ | ○ |
| | 9 INCHES | ○ | ○ |
| | 10 INCHES | ○ | ○ |

FIG. 17

| | SUM OF MAIN SCANNING AND SUB-SCANNING SIZES OF PRINTING MEDIUM | DENSITY UNEVENNESS IN MAIN SCANNING DIRECTION AND SUB-SCANNING DIRECTION | GRAININESS |
|---|---|---|---|
| FIRST PRINTING OPERATION | 8 INCHES | ◎ | ○ |
| | 10 INCHES | ○ | ○ |
| | 12 INCHES | △ | ○ |
| | 14 INCHES | × | ○ |
| | 16 INCHES | × | ◎ |
| | 18 INCHES | ×× | ◎ |
| SECOND PRINTING OPERATION | 8 INCHES | ◎ | △ |
| | 10 INCHES | ○ | △ |
| | 12 INCHES | ○ | ○ |
| | 14 INCHES | ○ | ○ |
| | 16 INCHES | ○ | ○ |
| | 18 INCHES | ○ | ○ |

FIG. 18

| | MAIN SCANNING PRINTING SIZE OF IMAGE DATA | DENSITY UNEVENNESS IN MAIN SCANNING DIRECTION AND SUB-SCANNING DIRECTION | GRAININESS |
|---|---|---|---|
| FIRST PRINTING OPERATION | 3 INCHES | ◎ | ○ |
| | 4 INCHES | ○ | ○ |
| | 5 INCHES | △ | ○ |
| | 6 INCHES | × | ○ |
| | 7 INCHES | × | ◎ |
| | 8 INCHES | ×× | ◎ |
| SECOND PRINTING OPERATION | 3 INCHES | ◎ | △ |
| | 4 INCHES | ○ | △ |
| | 5 INCHES | ○ | ○ |
| | 6 INCHES | ○ | ○ |
| | 7 INCHES | ○ | ○ |
| | 8 INCHES | ○ | ○ |

FIG. 20

| | SUB-SCANNING PRINTING SIZE OF PRINTING DATA | DENSITY UNEVENNESS IN MAIN SCANNING DIRECTION AND SUB-SCANNING DIRECTION | GRAININESS |
|---|---|---|---|
| FIRST PRINTING OPERATION | 5 INCHES | ◎ | ○ |
| | 6 INCHES | ○ | ○ |
| | 7 INCHES | △ | ○ |
| | 8 INCHES | × | ○ |
| | 9 INCHES | × | ◎ |
| | 10 INCHES | × × | ◎ |
| SECOND PRINTING OPERATION | 5 INCHES | ◎ | △ |
| | 6 INCHES | ○ | △ |
| | 7 INCHES | ○ | ○ |
| | 8 INCHES | ○ | ○ |
| | 9 INCHES | ○ | ○ |
| | 10 INCHES | ○ | ○ |

FIG. 21

| | SUM OF MAIN SCANNING AND SUB-SCANNING PRINTING SIZES OF PRINTING DATA | DENSITY UNEVENNESS IN MAIN SCANNING DIRECTION AND SUB-SCANNING DIRECTION | GRAININESS |
|---|---|---|---|
| FIRST PRINTING OPERATION | 8 INCHES | ◎ | ○ |
| | 10 INCHES | ○ | ○ |
| | 12 INCHES | △ | ○ |
| | 14 INCHES | × | ○ |
| | 16 INCHES | × | ◎ |
| | 18 INCHES | ×× | ◎ |
| SECOND PRINTING OPERATION | 8 INCHES | ◎ | △ |
| | 10 INCHES | ○ | △ |
| | 12 INCHES | ○ | ○ |
| | 14 INCHES | ○ | ○ |
| | 16 INCHES | ○ | ○ |
| | 18 INCHES | ○ | ○ |

PRINTING METHOD AND PRINTING APPARATUS

CLAIM OF PRIORITY

This application claims priority from Japanese Patent Application No. 2003-49972, entitled "Printing Method" and filed on Feb. 26, 2003, and Japanese Patent Application No. 2004-015521, entitled "Printing Method and Printing Apparatus" and filed on Jan. 23, 2004, the entire contents of which are incorporated herein by reference.

FIELD OF THE INVENTION

This invention relates to a printing method and printing apparatus and, more particularly, to a printing method and printing apparatus which print using an inkjet printhead.

BACKGROUND OF THE INVENTION

Printing apparatuses used as a printer, a copying machine, a facsimile apparatus, or an output apparatus for a multi-function electronic apparatus or work station including a computer or wordprocessor print images (including characters and the like) on printing media such as a printing sheet and thin plastic plate on the basis of image information (including character information and the like).

Such printing apparatuses can be classified by the printing method into an inkjet method, wire dot method, thermal method, electro-photographic method, and the like. Of printing apparatuses complying with these methods, a printing apparatus complying with the inkjet method (to be referred to as inkjet printing apparatuses hereinafter) prints by discharging ink from a printhead onto a printing medium. Compared to printing apparatuses according to other printing methods, the inkjet printing apparatus easily achieves high definition, high speed, quiet operation and low cost.

To meet recent needs for color printing, many color inkjet printing apparatuses have also been developed.

Generally in the inkjet printing apparatus, the integration of ink orifices and liquid channels serving as ink discharge portions is adopted in a printhead formed by integrating and arraying a plurality of printing elements. To cope with color printing, a plurality of printheads are mounted to the apparatus.

If an ink droplet discharged from the printhead is downsized to obtain a high-quality image almost free from graininess, density unevenness and color unevenness which have not occurred in a conventional printhead occur.

One of the factors that generate such density unevenness and color unevenness are probably the fact that the ink droplet adhering position on a printing medium in the main scanning direction periodically shifts by vibrations of a carriage due to a small ink droplet size in printing while the carriage to which the printhead is mounted moves in the carriage moving direction (main scanning direction). Also, density unevenness and color unevenness are probably attributed to the fact that the ink droplet adhering position on a printing medium in the printing medium conveyance direction (sub-scanning direction) periodically shifts in the conveyance direction (sub-scanning direction). Such shifts of the ink droplet adhering position in the main scanning direction and sub-scanning direction stand out more with a larger printing medium size and larger image data size.

In grayscale printing by an inkjet printing apparatus, a dot layout pattern corresponding to the gradation levels (also referred to as "quantization levels") of pixels is assigned.

The gradation level includes not only a halftone level of achromatic color but also a halftone level of chromatic color (e.g. cyan, magenta and yellow). For example, Japanese Patent Publication Laid-Open No. 9-46522 discloses a method of assigning plural types of dot layout patterns to a plurality of pixels at the same gradation level (quantization level). In this arrangement, dots are laid out at different intervals within a region formed by a plurality of pixels at the same gradation level, resulting in a noise-added printing state.

Even if the dot adhering position shifts along with the above-mentioned carriage movement or print medium conveyance operation, density unevenness is hardly recognized because noise is inherently added if plural types of dot layout patterns are used. However, if plural types of dot layout patterns are used, sparse and dense dot patterns are generated within a region formed by a plurality of pixels at the same gradation level. The sparse and dense dot patterns lead to graininess. Graininess becomes conspicuous especially at low gradation level.

SUMMARY OF THE INVENTION

Accordingly, the present invention is conceived as a response to the above-described disadvantages of the conventional art.

For example, a printing method and a printing apparatus using the method according to the present invention are capable of printing a high-quality image free from any visual graininess while sufficiently reducing density unevenness and color unevenness.

According to one aspect of the present invention, preferably, a printing method of printing by discharging ink from a printhead onto a printing medium on the basis of a dot layout pattern corresponding to a gradation level of each pixel, comprises: a selection step of selecting one printing operation mode from a first printing operation mode in which one dot layout pattern is assigned to a plurality of pixels at the same gradation level and printing is done on the basis of the assigned dot layout pattern, and a second printing operation mode in which plural types of dot layout patterns are assigned to a plurality of pixels at the same gradation level and printing is done on the basis of the assigned dot layout patterns; and a printing step of executing the printing operation mode selected in the selection step.

According to another aspect of the present invention, preferably, a printing method of printing by discharging ink from a printhead onto a printing medium, comprises: a determination step of determining a dot layout pattern to be assigned to each pixel in accordance with at least one information out of information on a size of the printing medium and information on a size of image data; and a printing step of printing each pixel on the basis of the determined dot layout pattern, wherein the determination step determines whether to assign one dot layout pattern or plural types of dot layout patterns to a plurality of pixels at a predetermined level in which a predetermined number of dots are printed in accordance with the at least one information.

In this method, one type of dot layout pattern assigned to the pixels at the predetermined level may include a pattern for printing dots at the same position within the pixel, and the plural types of dot layout patterns assigned to the pixels at the predetermined level may include a pattern for printing dots at different positions within the pixel.

The plural types of dot layout patterns assigned to the pixels at the predetermined level may also include a pattern for printing dots at different positions within the pixel, and a pattern for printing dots at the same position within the pixel.

The present invention may also be realized by applying the method having the above steps to a printing apparatus. The printing apparatus has the following arrangement.

More specifically, a printing apparatus which prints by discharging ink from a printhead onto a printing medium on the basis of a dot layout pattern corresponding to a gradation level of each pixel, comprises:

first printing means for executing a first printing operation mode in which one dot layout pattern is assigned to a plurality of pixels at the same gradation level and printing is done on the basis of the assigned dot layout pattern; and second printing means for executing a second printing operation mode in which plural types of dot layout patterns are assigned to a plurality of pixels at the same gradation level and printing is done on the basis of the assigned dot layout patterns.

The printing apparatus may also have the following arrangement.

More specifically, a printing apparatus which prints by discharging ink from a printhead onto a printing medium on the basis of a dot layout pattern corresponding to a gradation level of each pixel, comprises:

first printing means for executing a first printing operation mode in which one dot layout pattern is assigned to a pixel corresponding to a predetermined gradation level out of a plurality of gradation levels and printing is done on the basis of the assigned dot layout pattern; and second printing means for executing a second printing operation mode in which plural types of dot layout patterns are assigned to a pixel corresponding to the predetermined gradation level and printing is done on the basis of the assigned dot layout patterns.

Further, the printing apparatus may also have the following arrangement.

More specifically, a printing apparatus which prints by discharging ink from a printhead onto a printing medium, comprises: first printing means for executing a first printing operation mode in which a dot layout pattern for printing dots at the same position within a pixel is assigned to a pixel corresponding to a predetermined gradation level out of a plurality of gradation levels and printing is done on the basis of the assigned dot layout pattern; and second printing means for executing a second printing operation mode in which plural types of dot layout patterns including a dot layout pattern for printing dots at different positions within the pixel are assigned to a pixel corresponding to the predetermined gradation level and printing is done on the basis of the assigned dot layout patterns.

Furthermore, the printing apparatus may also have the following arrangement.

More specifically, a printing apparatus which prints by discharging ink from a printhead onto a printing medium, comprises: determination means for determining a dot layout pattern to be assigned to each pixel in accordance with at least one information out of information on a size of the printing medium and information on a size of image data; and printing means for printing each pixel on the basis of the dot layout pattern determined by the determination means, wherein the determination means determines, in accordance with the at least one information, whether to assign one dot layout pattern or plural types of dot layout patterns to a plurality of pixels at a predetermined level in which a predetermined number of dots are printed.

In the printing apparatus having the above arrangement, a more detailed arrangement preferably further comprises scanning means for reciprocally scanning the printhead in a first direction (main scanning direction), and conveyance means for conveying the printing medium in a second direction (sub-scanning direction) different from the first direction, the size of the printing medium preferably includes at least any one of a size in the first direction, a size in the second direction, and a sum of the sizes in the first and second directions, and the size of the image data preferably includes at least any one of a size in the first direction, a size in the second direction, and a sum of the sizes in the first and second directions.

The printing means preferably includes multi-pass printing control means for controlling so as to scan a region printable by one scanning using all printing elements of the printhead by the printhead plural number of times, thereby completing printing in the region.

The above-mentioned single dot layout pattern assigned to the pixels at the predetermined level preferably includes a pattern for printing dots at the same position within the pixel, and the plural types of dot layout patterns assigned to the pixels at the predetermined level preferably include a pattern for printing dots at different positions within the pixel.

In this case, the plural types of dot layout patterns assigned to the pixels at the predetermined level preferably include a pattern for printing dots at different positions within the pixel, and a pattern for printing dots at the same position within the pixel.

In printing the pattern for printing dots at different positions within the pixel, dots are preferably printed at the different positions by changing a dot position in a first direction in which the printhead is scanned by the scanning means.

In printing the pattern for printing dots at different positions within the pixel, ink droplets are preferably printed at the different positions by changing a dot position in a second direction in which the printing medium is conveyed by the conveyance means.

The invention is particularly advantageous since a high-quality image almost free from graininess can be printed while density unevenness is suppressed.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 5 is a table for explaining the relationship among the quantization level of image data, the number of printing dots, and pixel data according to the first embodiment;

FIGS. 7A, 7B, and 7C are views for explaining a dot layout within one pixel at a resolution of 600×600 dpi for pixel data printed by printing operation shown in FIG. 6;

FIGS. 10A, 10B, and 10C are views for explaining a dot layout within one pixel at a resolution of 600×600 dpi for pixel data printed by printing operation shown in FIG. 9;

FIG. 12 is a table showing the relationship among the main scanning sizes of printing media printed by the first and second printing operations, density unevenness in the main scanning and sub-scanning directions, and graininess;

FIGS. 14A, 14B, and 14C are views for explaining a printing dot layout within each printing pixel on a printing medium when printing is done according to a first modification to the first embodiment;

FIG. 16 is a table showing the relationship among the sub-scanning size of the printing medium, density unevenness in the main scanning and sub-scanning directions, and graininess according to a second modification to the first embodiment;

FIG. 17 is a table showing the relationship among the sum of the main scanning and sub-scanning sizes of the printing medium, density unevenness in the main scanning and sub-scanning directions, and graininess according to the second modification to the first embodiment;

FIG. 18 is a table showing the relationship among the main scanning sizes of images printed on printing media by the first and second printing operations, density unevenness in the main scanning and sub-scanning directions, and graininess;

FIG. 20 is a table showing the relationship among the sub-scanning size of an image printed on a printing medium, density unevenness in the main scanning and sub-scanning directions, and graininess according to a modification to the second embodiment;

FIG. 21 is a table showing the relationship among the sum of the main scanning and sub-scanning sizes of an image printed on a printing medium, density unevenness in the main scanning and sub-scanning directions, and graininess according to another modification to the second embodiment.

DETAILED DESCRIPTION OF THE PREFERRED EMBODIMENTS

Preferred embodiments of the present invention will now be described in detail in accordance with the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (also referred to as "liquid") should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

Figure 1:
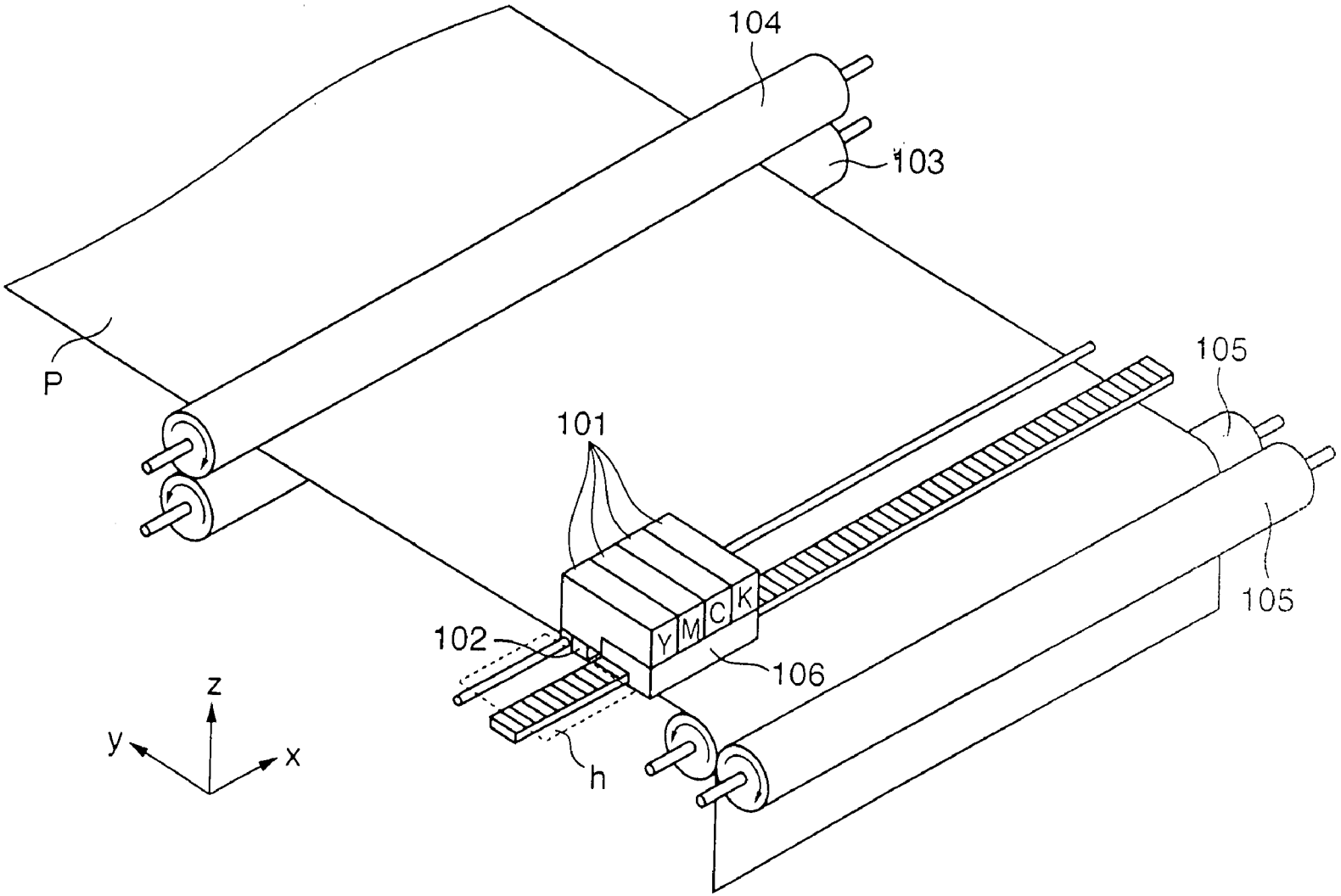
FIG. 1 is a perspective view schematically showing the whole arrangement of an inkjet printing apparatus as a typical embodiment of the present invention.

FIG. 1 is a perspective view schematically showing the whole arrangement of an inkjet printing apparatus (to be referred to as a printing apparatus hereinafter) as a typical embodiment of the present invention.

As shown in FIG. 1, a carriage 106 which reciprocates in the x direction (main scanning direction) supports an ink cartridge comprised of a printhead 102 and ink tanks 101 which store four color inks: black (K), cyan (C), magenta (M), and yellow (Y) inks.

In printing, a conveyance roller 103 and auxiliary roller 104 rotate in directions indicated by arrows shown in FIG. 1 while clamping a printing medium P. Every time printing of one scanning by the printhead 102 is completed, the printing medium P is conveyed in the y direction (sub-scanning direction). At the start of printing, paper feed rollers 105 feed the printing medium P, and also clamp it, similar to the conveyance roller 103 and auxiliary roller 104.

When no printing is done or recovery operation of the printhead 102 or the like is performed, the carriage 106 moves to a position (home position (h)) represented by a dotted line in FIG. 1, and stands by at this position.

Figure 2:
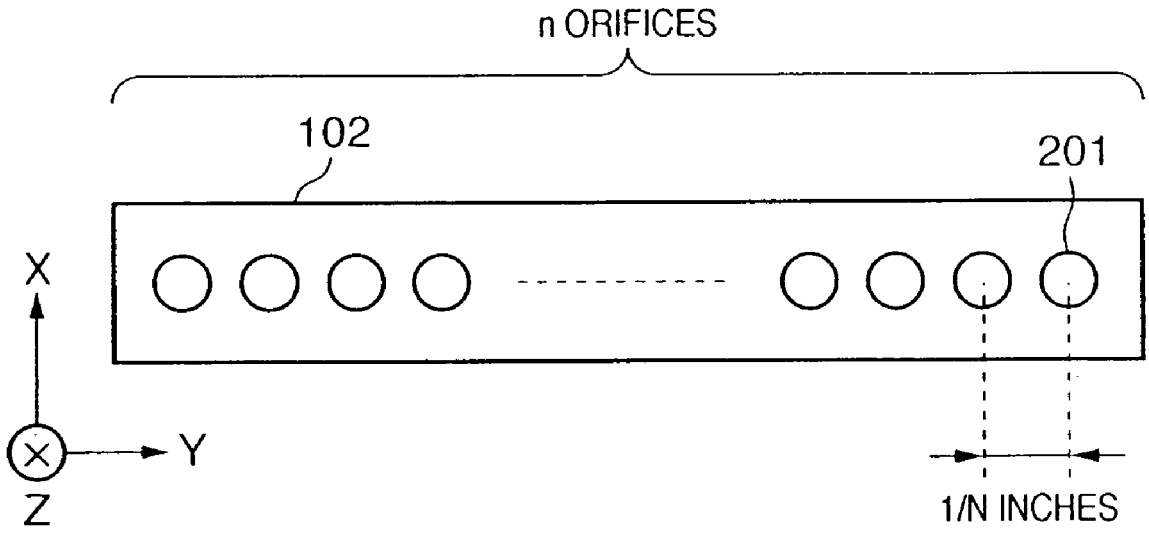
FIG. 2 is a view showing ink orifices arrayed in a printhead 102 when viewed from the z direction.

FIG. 2 is a view showing ink orifices arrayed in the printhead 102 when viewed from the z direction.

In FIG. 2, reference numeral 201 denotes a plurality of orifices arrayed in the printhead 102.

Printing operation by one scanning of the carriage will be explained with reference to FIGS. 1 and 2.

The carriage 106 is at the home position h in FIG. 1 before the start of printing. When the printing apparatus receives a printing start instruction from a host (not shown), the carriage 106 discharges ink onto a printing medium P from the orifices 201 of the printhead 102 and prints in accordance with received printing data while moving in the x direction. When printing ends up to the end of the printing medium (side opposite to the home position), the carriage 106 returns to the original home position h. During the period of this return, the printing medium P is conveyed by a printing width corresponding to one scanning by the printhead in the y direction. After that, the carriage 106 again moves in the x direction to print.

Figure 3:
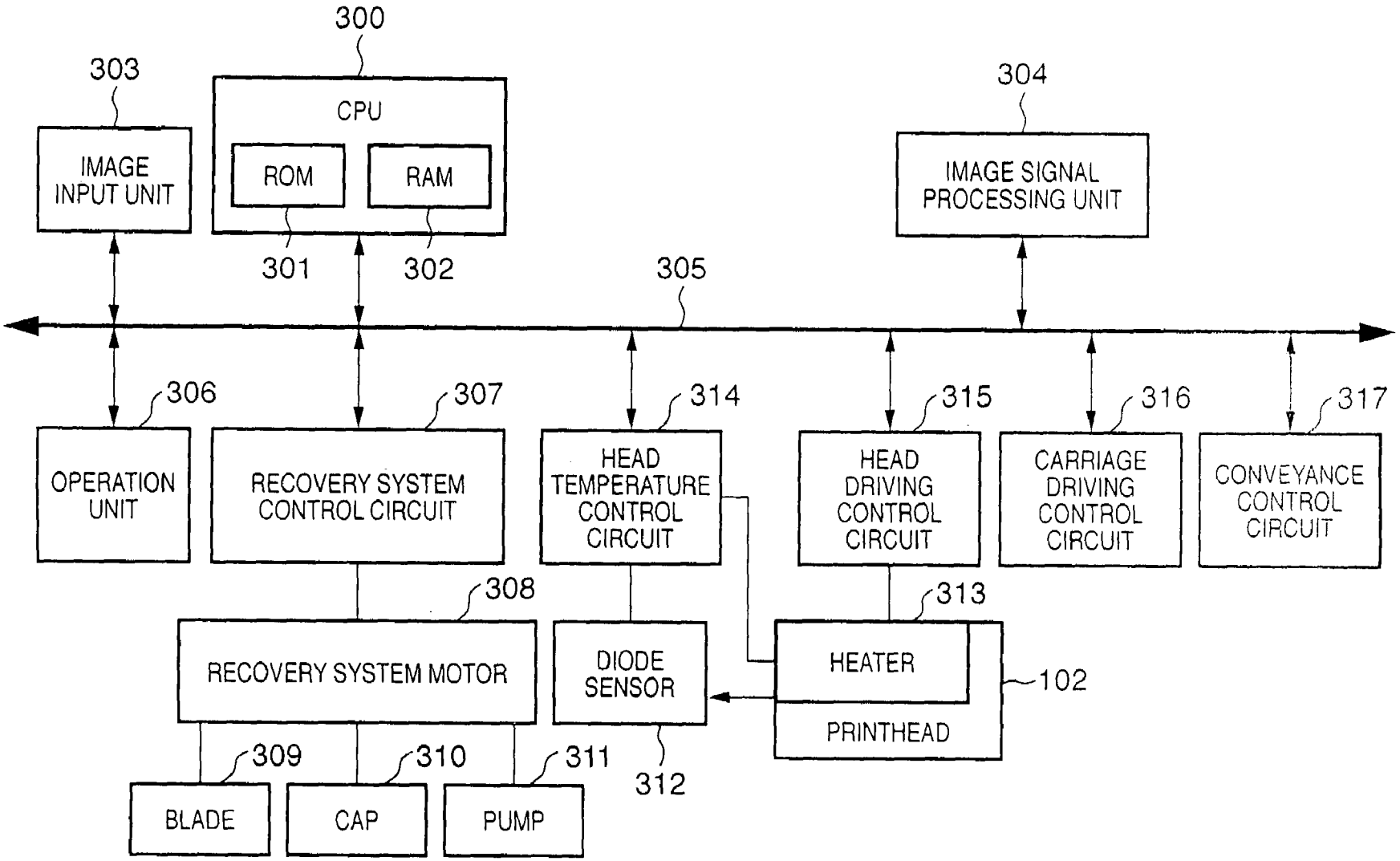
FIG. 3 is a block diagram showing the control arrangement of the printing apparatus shown in FIG. 1.

FIG. 3 is a block diagram showing the control arrangement of the printing apparatus shown in FIG. 1.

As shown in FIG. 3, the control arrangement of the printing apparatus is roughly divided into a data processing subsystem including: an image input unit 303; a corresponding image signal processing unit 304; and a CPU 300, and a mechanism control processing subsystem including: an operation unit 306; a recovery system control circuit 307; a head temperature control circuit 314; a head driving control circuit 315; a carriage driving control circuit 316; and a conveyance control circuit 317. These units respectively access a main bus line 305. The image input unit 303 comprises an interface for inputting printing data from a host computer (not shown); an interface for inputting image data from a digital camera (not shown); and an interface for inputting image data from an IC memory card (not shown).

The CPU 300 comprises memories such as a ROM 301 and RAM 302. The CPU 300 gives proper printing conditions for input information, and drives the printhead 102 to print. The RAM 302 stores in advance a program for executing a head recovery timing sequence. If necessary, recovery conditions such as preliminary discharge conditions are supplied to the recovery system control circuit 307, the head driving control circuit 315, and the like.

A recovery system motor 308 drives the printhead 102, and a cleaning blade 309, a cap 310, and a pump 311 which face the printhead 102 at intervals. The head driving control circuit 315 executes a sequence according to the driving conditions of the printing elements (electrothermal transducers) of the printhead 102. In general, the head driving control circuit 315 causes the printhead 102 to perform ink preliminary discharge and printing ink discharge.

As shown in FIG. 3, a heater 313 is arranged on a substrate having the printing elements of the printhead 102. By energizing the heater, the ink temperature in the printhead can be adjusted to a desired setting temperature. A diode sensor 312 is similarly arranged on the substrate, and measures an actual ink temperature in the printhead. The diode sensor 312 may be arranged on the substrate, similar to the heater 313, but may be arranged outside the substrate or around the printhead.

Several embodiments having the above apparatus arrangement will be explained.

First Embodiment

Figure 4:
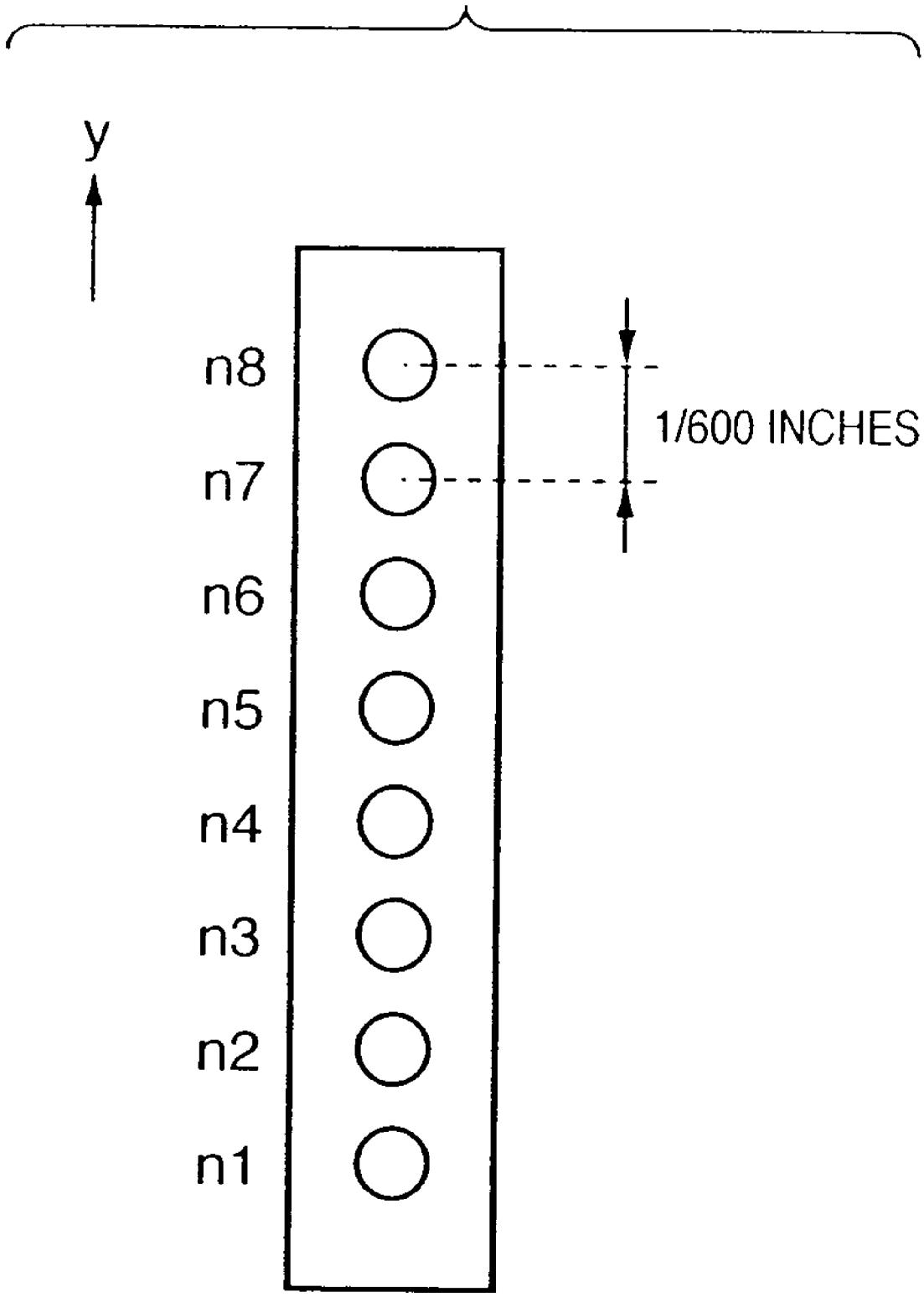
FIG. 4 is a view showing the layout of the ink orifices of a printhead 102 according to a first embodiment.

FIG. 4 is a view showing the layout of the ink orifices of a printhead 102 according to a first embodiment. As described above, any one of black (K), cyan (C), magenta (M), and yellow (Y) inks is discharged from the ink orifices.

The printhead shown in FIG. 4 has n=8 orifices (8 nozzles) at a density N=600 dots per inch (600 dpi) in the sub-scanning direction. n1 to n8 shown in FIG. 4 represent nozzle numbers, and the size of an ink droplet from each ink orifice is about 5 pl. Each ink orifice incorporates a corresponding printing element (electrothermal transducer).

FIG. 5 is a table for explaining the relationship among the quantization level (gradation level) of image data, the number of printing dots, and pixel data according to the first embodiment.

In the first embodiment, image data is multi-valued image data having a resolution of 600×600 dpi per pixel, and is quantized to five levels from 0 to 4. More specifically, image data is 4-bit data (to be referred to as pixel data hereinafter) corresponding to the quantization level. This quantization may be executed by an image signal processing unit 304 after multi-valued image data is input to an image input unit 303, or input image data may be quantized data in order to reduce the load on the printing apparatus.

As shown in FIG. 5, at quantization level 0, no ink is discharged, the number of printing dots for one pixel is "0", and 4-bit pixel data has one type "0000" at which all the bits are OFF. At quantization level 1, a single ink discharge operation occurs, the number of printing dots for one pixel is "1", and 4-bit pixel data has four types: "0001"; "0010"; "0100"; and "1000" at which any one bit is ON. At quantization level 2, two ink discharge operations occur, the number of printing dots for one pixel is "2", and 4-bit pixel data has six types: "0011"; "0101"; "0110"; "1001"; "1010"; and "1100" at which any two bits are ON.

At quantization level 3, three ink discharge operations occur, the number of printing dots for one pixel is "3", and 4-bit pixel data has four types: "0111"; "1011"; "1101"; and "1110" at which any three bits are ON. At quantization level 4, four ink discharge operations occur, the number of printing dots for one pixel is "4", and 4-bit pixel data has one type "1111" at which all the bits are ON.

In the first embodiment, pixel data to be printed is selected in accordance with the quantization level, and ink droplets are discharged and printed in a lattice at a resolution of 600×600 dpi. At a quantization level (quantization level 1, 2, or 3) corresponding to pixel data in which plural types of bit patterns exist, one of the bit patterns is selected at random.

Figure 6:
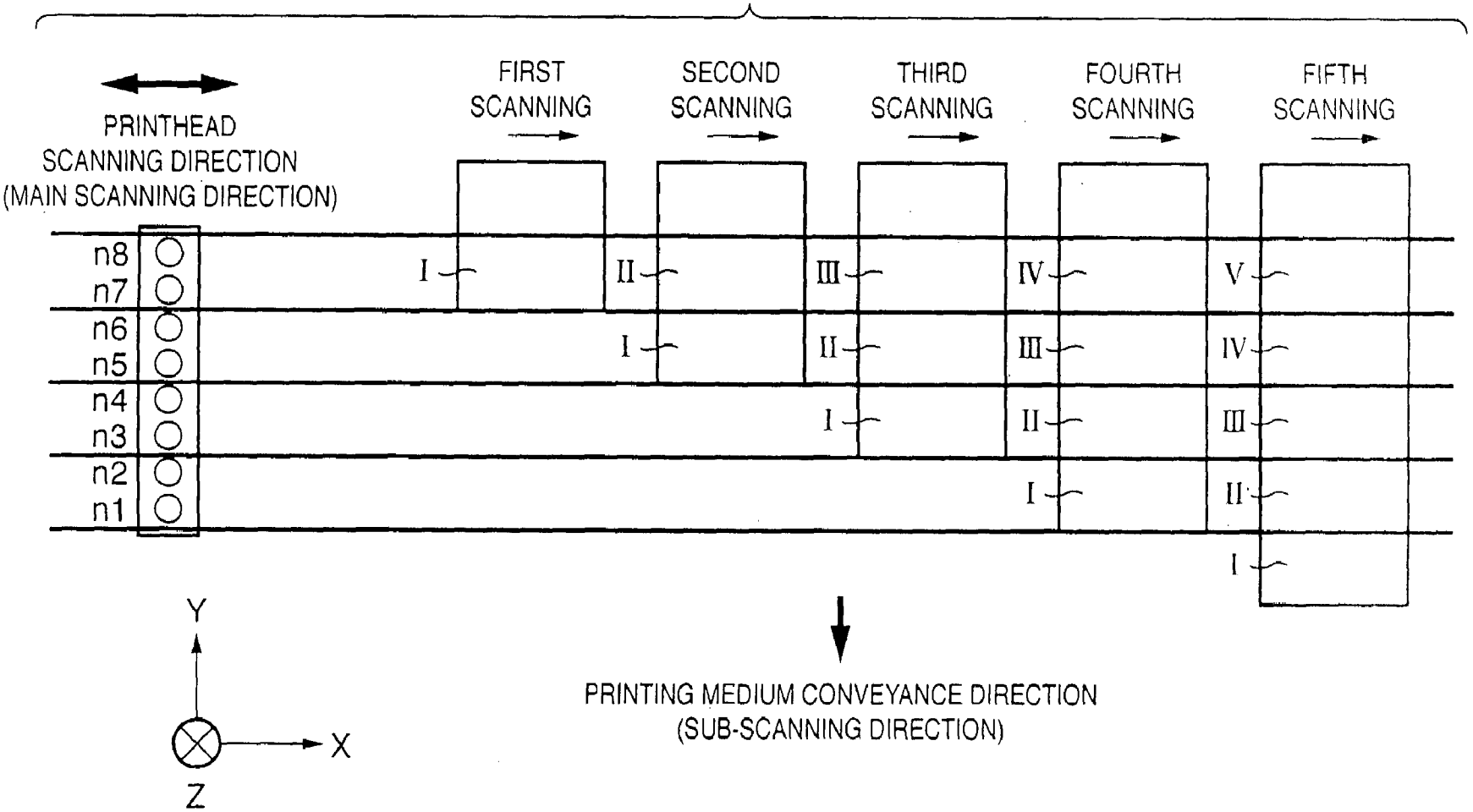
FIG. 6 is a view for explaining the first printing operation according to the first embodiment.

FIG. 6 is a view for explaining the first printing operation according to the first embodiment.

In FIG. 6, a region (printing region corresponding to the entire nozzle width of the printhead) printable by one scanning operation using all the ink orifices of the printhead is printed by four scanning operations in accordance with 4-bit image data of one pixel (multi-pass printing).

FIGS. 7A to 7C are views for explaining a dot layout (ink droplet adhering position) pattern within one pixel at a resolution of 600×600 dpi for pixel data printed by printing operation shown in FIG. 6.

FIG. 7A shows 4-bit pixel data of bit data "a" to "d". FIG. 7B shows a state in which a dot is laid out at an upper left position "a" when a lattice of 600×600 dpi is segmented into 2×2 lattices of 1,200×1,200 dpi. FIG. 7C shows dots laid out at the position "a" in accordance with the quantization level. In the first printing operation, a dot layout pattern as shown in FIG. 7C corresponding to pixel quantization is assigned to each pixel.

Referring back to FIG. 6, in printing by the first scanning, a printing medium is conveyed in the sub-scanning direction by a conveyance amount of 2/600 inches corresponding to ¼ of the entire nozzle width. Only data at the bit position "a" out of the pixel data in FIG. 7A is selected and printed using orifices n7 and n8 of the printhead for an image region I. More. specifically, the discharge timing of the printhead in the main scanning direction is a timing dischargeable at a resolution which is twice a resolution corresponding to ½ of a 600-dpi printing pixel in the main scanning direction. Printing is done in the forward direction along the main scanning direction while ink is discharged only at the first half of the discharge timing corresponding to ½ of the 600-dpi printing pixel in the main scanning direction. In this manner, a printing dot is laid out and printed for each pixel at the position "a" in FIG. 7B.

In the second scanning, the printing medium P is conveyed in the sub-scanning direction by a conveyance amount of 2/600 inches. Only data at the bit position "b" out of the pixel data in FIG. 7A is selected and printed using orifices n5 and n6 for the image region I and the orifices n7 and n8 for an image region II. More specifically, printing is done in the forward direction along the main scanning direction while ink is discharged to the same lattice point as that in the first scanning operation only at the first half of the discharge timing corresponding to ½ of the 600-dpi printing pixel in the main scanning direction. A printing dot is laid out and printed for each pixel at the position "a" in FIG. 7B.

In the third scanning, the printing medium P is conveyed in the sub-scanning direction by a conveyance amount of 2/600 inches. Only data at the bit position "c" out of the pixel data in FIG. 7A is selected and printed using orifices n3 and n4 for the image region I, the orifices n5 and n6 for the image region II, and the orifices n7 and n8 for the image region III. More specifically, printing is done in the forward direction along the main scanning direction while ink is discharged to the same lattice points as those in the first and second scanning operations only at the first half of the discharge timing corresponding to ½ of the 600-dpi printing pixel in the main scanning direction. A printing dot is laid out and printed for each pixel at the position "a" in FIG. 7B.

In the fourth scanning, the printing medium P is conveyed in the sub-scanning direction by a conveyance amount of 2/600 inches. Only data at the bit position "d" out of the pixel data in FIG. 7A is selected and printed using orifices n1 and n2 for the image region I, the orifices n3 and n4 for the image region II, the orifices n5 and n6 for the image region III, and the orifices n7 and n8 for the image region IV. More specifically, printing is done in the forward direction along the main scanning direction while ink is discharged to the same lattice points as those in the first to third scanning operations only at the first half of the discharge timing corresponding to ½ of the 600-dpi printing pixel in the main scanning direction. A printing dot is laid out and printed for each pixel at the position "a" in FIG. 7B.

Printing is performed in the fifth and subsequent scanning operations by the same method as that of the first to fourth scanning operations.

FIGS. 8A to 8D are views each showing the dot distribution of 2×2 pixels printed by the first printing operation in correspondence with each quantization level.

Figure 8A:
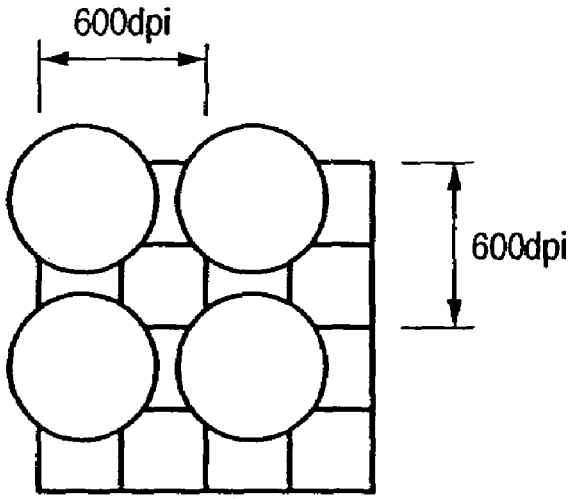
FIGS. 8A, 8B, 8C, and 8D are views each showing the dot distribution of 2×2 pixels printed by the first printing operation at each quantization level.
Figure 8B:
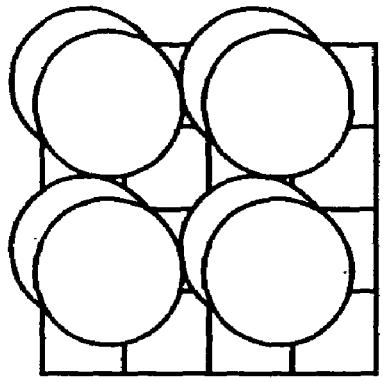
Figure 8C:
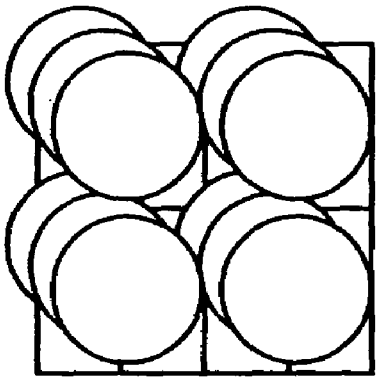
Figure 8D:
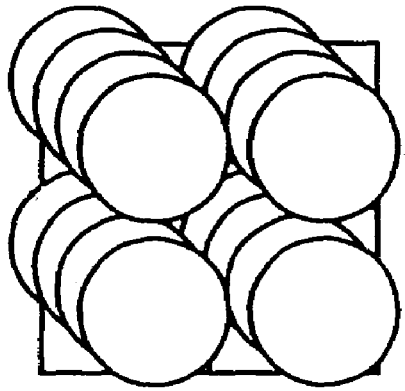

FIG. 8A shows quantization level 1, FIG. 8B shows quantization level 2, FIG. 8C shows quantization level 3, and FIG. 8D shows quantization level 4. From FIGS. 8A to 8D, dots are laid out at the same interval at any level.

Figure 9:
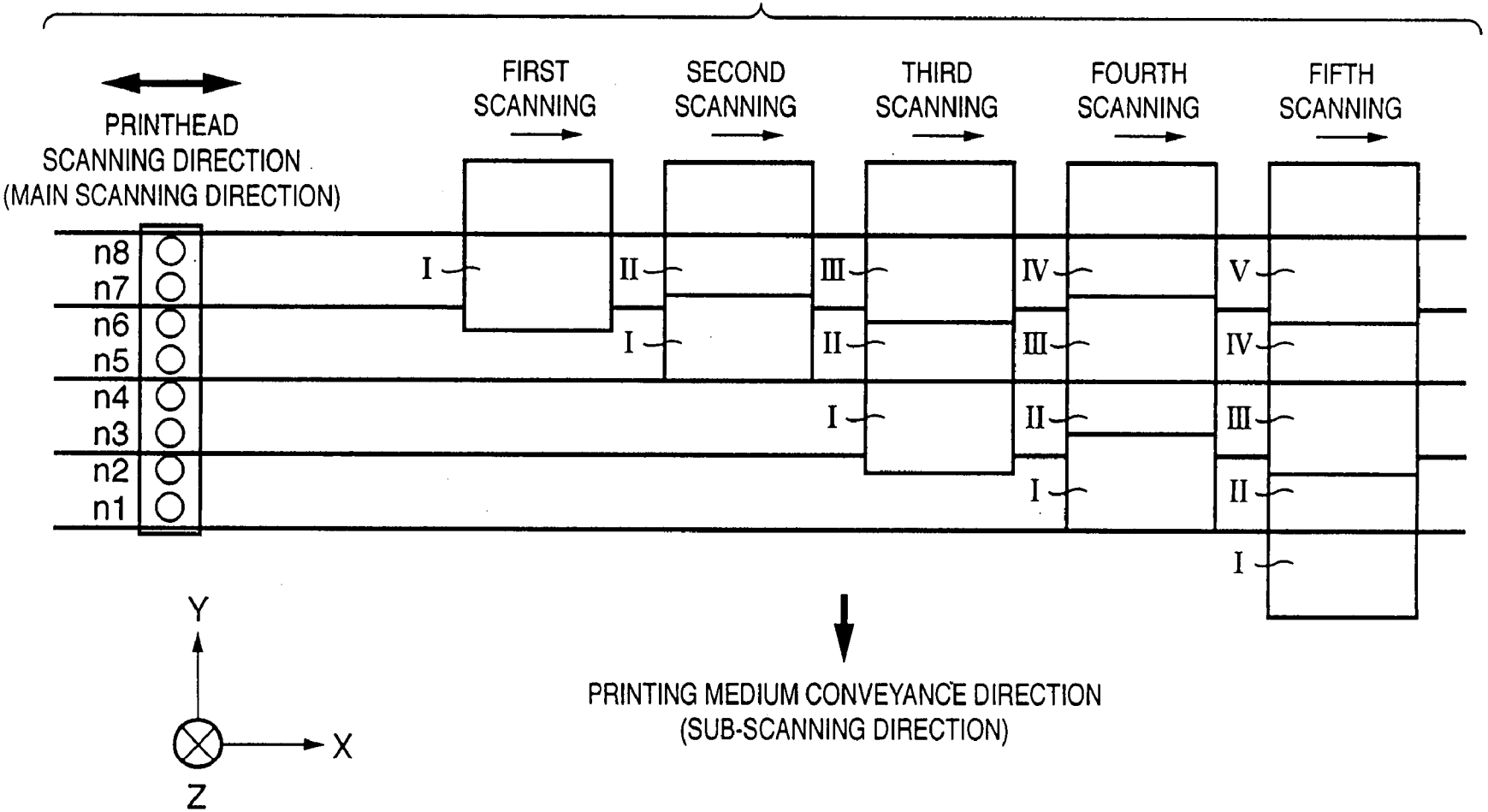
FIG. 9 is a view for explaining the second printing operation according to the first embodiment.

FIG. 9 is a view for explaining a second printing operation according to the first embodiment.

Also in FIG. 9, similar to the first printing operation, a region printable by one scanning operation using all the ink orifices of the printhead is printed by four scanning operations in accordance with 4-bit image data of one pixel (multi-pass printing).

FIGS. 10A to 10C are views for explaining a dot layout (ink droplet adhering position) pattern within one pixel at a resolution of 600×600 dpi for pixel data printed by printing operation shown in FIG. 9.

FIG. 10A shows 4-bit pixel data of bit data "a" to "d". FIG. 10B shows a state in which dots are laid out at an upper left position "a" and lower left position "b" when a lattice of 600×600 dpi is segmented into 2×2 lattices of 1,200×1,200 dpi. FIG. 10C shows dots laid out at the positions "a" and "b" in accordance with the quantization level. In the second printing operation, a dot layout pattern as shown in FIG. 10C corresponding to pixel quantization is assigned to each pixel.

As shown in FIG. 10C, quantization level 1 has two dot layout (ink droplet adhering position) patterns, quantization level 2 has three dot layout patterns, quantization level 3 has four dot layout patterns, and quantization level 4 has five dot layout patterns.

Referring back to FIG. 9, in printing by the first scanning, a printing medium is conveyed in the sub-scanning direction by a conveyance amount of 2.5/600 (=5/1200) inches corresponding to about ¼ of the entire nozzle width of the printhead. Only data at the bit position "a" out of the pixel data in FIG. 10A is selected and printed using the orifices n7 and n8 of the printhead for the image region I. More specifically, printing is done in the forward direction along the main scanning direction while ink is discharged only at the first half of the discharge timing corresponding to ½ of the 600-dpi printing pixel in the main scanning direction. A printing dot is laid out and printed for each pixel at the position "b" in FIG. 10B.

In the second scanning, the printing medium P is conveyed in the sub-scanning direction by a conveyance amount of 1.5/600 (=3/1200) inches. Only data at the bit position "b" out of the pixel data in FIG. 10A is selected and printed using the orifices n5 and n6 for the image region I and the orifices n7 and n8 for the image region II. More specifically, printing is done in the forward direction along the main scanning direction while ink is discharged to a position shifted from the dot printing position of the first scanning by 1/1200 inches in the sub-scanning direction only at the first half of the discharge timing corresponding to ½ of the 600-dpi printing pixel in the main scanning direction. A printing dot is laid out and printed for each pixel at the position "a" in FIG. 10B.

In the third scanning, the printing medium P is conveyed in the sub-scanning direction by a conveyance amount of 2.5/600 (=5/1200) inches. Only data at the bit position "c" out of the pixel data in FIG. 10A is selected and printed using the orifices n3 and n4 for the image region I, the orifices n5 and n6 for the image region II, and the orifices n7 and n8 for the image region III. More specifically, printing is done in the forward direction along the main scanning direction while ink is discharged to only the same lattice point as that in the first scanning operation only at the first half of the discharge timing corresponding to ½ of the 600-dpi printing pixel in the main scanning direction. A printing dot is laid out and printed for each pixel at the position "b" in FIG. 10B.

In the fourth scanning, the printing medium P is conveyed in the sub-scanning direction by a conveyance amount of 1.5/600 (=3/1200) inches. Only data at the bit position "d" out of the pixel data in FIG. 10A is selected and printed using the orifices n1 and n2 for the image region I, the orifices n3 and n4 for the image region II, the orifices n5 and n6 for the image region III, and the orifices n7 and n8 for the image region IV. More specifically, printing is done in the forward direction along the main scanning direction while ink is discharged to only the same lattice point as that in the second scanning operation only at the first half of the discharge timing corresponding to ½ of the 600-dpi printing pixel in the main scanning direction. A printing dot is laid out and printed for each pixel at the position "a" in FIG. 10B.

Printing is performed in the fifth and subsequent scanning operations by the same method as that of the first to fourth scanning operations.

FIGS. 11A to 11D are views each showing the dot distribution of 2×2 pixels printed by the second printing operation in correspondence with each quantization level.

Figure 11A:
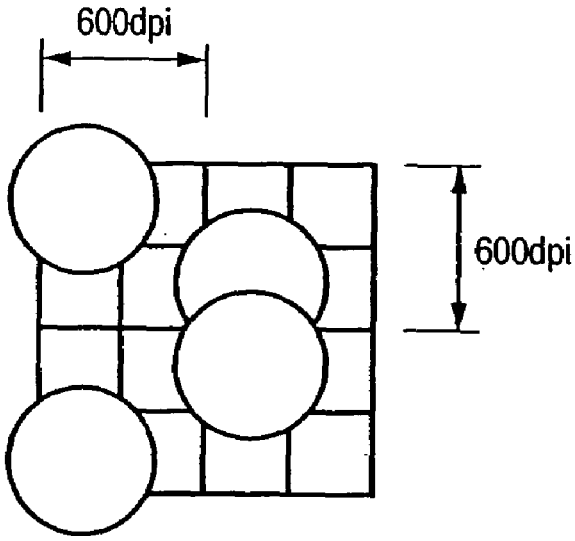
FIGS. 11A, 11B, 11C, and 11D are views each showing the dot distribution of 2×2 pixels printed by the second printing operation at each quantization level.
Figure 11B:
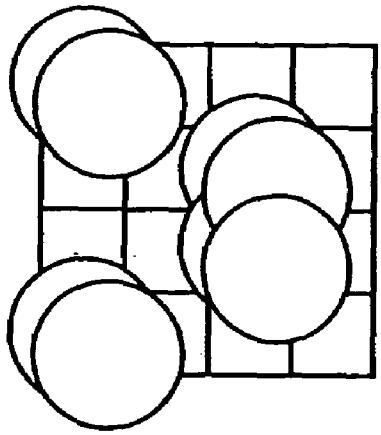
Figure 11C:
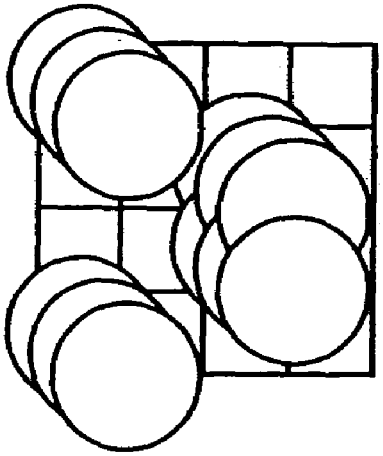
Figure 11D:
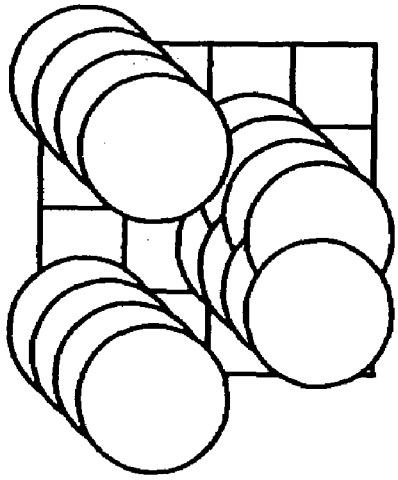

FIG. 11A shows quantization level 1, FIG. 11B shows quantization level 2, FIG. 11C shows quantization level 3, and FIG. 11D shows quantization level 4. From FIGS. 11A to 11D, dots are laid out at different intervals at any level. In these dot layouts, all upper left and lower right pixels are printed at the position "a" in FIG. 10B, and all upper right and lower left pixels are printed at the position "b" in FIG. 10B in a matrix of 2×2 pixels at 600×600 dpi shown in FIGS. 11A to 11D.

The qualities of images printed by the first and second printing operations will be examined.

FIG. 12 is a table showing the relationship among the main scanning sizes of printing media printed by the first and second printing operations, density unevenness in the main scanning and sub-scanning directions, and graininess.

In FIG. 12, the quality of a printed image is evaluated at five levels. "◎" means "excellent", "○" means "good", "Δ" means "fair", "x" means "not good", and "xx" means "bad".

As premises in both the first and second printing operations, density unevenness is suppressed for a smaller printing medium size, and graininess is suppressed for a larger printing medium size. Density unevenness hardly stands out for a smaller printing medium size because the generation period of density unevenness visually relatively prolongs for a smaller printing medium size, and the number of sparse and dense patterns suffering density unevenness decreases. Graininess is reduced for a larger printing medium size because the greater the visual distance from the printing medium becomes the higher the spatial frequency visually becomes.

The first printing operation will be examined. In the first printing operation, density unevenness in the main scanning and sub-scanning directions exhibits good level when the main scanning size of the printing medium is 4 inches or less. However, when the size exceeds 4 inches, the image quality is no longer good, and density unevenness becomes notable. The first printing operation uses only one dot layout pattern (see FIG. 7C) as a dot layout pattern corresponding to each quantization level. Thus, periodic density unevenness is originally conspicuous. Especially, for a large-size printing medium on which density unevenness tends to stand out, the density unevenness level cannot be permitted. To the contrary, not only graininess is suppressed as the main scanning size of the printing medium increases, but also it is still sufficiently suppressed even for a small-size printing medium. In the first printing operation, graininess tends to hardly stand out as a whole because printing dots are laid out at the same interval at any quantization level by using the dot layout pattern in FIG. 7C, as shown in FIGS. 8A to 8D. As the main scanning size of the printing medium increases, the visual distance from the printing medium increases. Thus, graininess is reduced for a larger main scanning size of the printing medium. Even at a size of 4 inches or less at which graininess is relatively noticeable, graininess is still well suppressed by the first printing operation. Considering these matters, when the first printing operation is adopted for a relatively-large-size printing medium, graininess is suppressed, but density unevenness becomes notable. On the other hand, when the first printing operation is adopted for a relatively-small-size printing medium, an image in which both density unevenness and graininess are suppressed can be printed.

In the second printing operation, density unevenness in the main scanning and sub-scanning directions exhibits good level regardless of the main scanning size of the printing medium. That is, the second printing operation uses plural types of dot layout patterns (see FIG. 10C) as a dot layout pattern corresponding to each quantization level. Noise is originally added, and periodic density unevenness originally hardly stands out. Even for a large-size printing medium on which density unevenness tends to be conspicuous, density unevenness is sufficiently reduced, and the density unevenness level is satisfactorily good. To the contrary, graininess is slightly worse than that in the first printing operation because printing dots are laid out at different intervals at any quantization level, as shown in FIGS. 11A to 11D, in other words, noise is inherently added. As the main scanning size of the printing medium decreases, the visual distance from the printing medium becomes smaller. Thus, graininess stands out for a small-size printing medium.

As understood from FIG. 12, the graininess level is no longer good when the size of the printing medium is 4 inches or less. Considering these matters, when the second printing operation is adopted for a relatively-small-size printing medium, density unevenness is suppressed, but graininess becomes conspicuous. When the second printing operation is adopted for a relatively-large-size printing medium, an image in which both density unevenness and graininess are suppressed can be printed.

As summarized, when the second printing operation is employed for a relatively-small-size printing medium, density unevenness is suppressed, but graininess becomes notable, failing to reduce both density unevenness and graininess. To the contrary, when the first printing operation is employed, both density unevenness and graininess can be reduced. Hence, for a relatively-small-size printing medium, it is preferable to use the first printing operation of printing using one dot layout pattern as shown in FIG. 7C as a dot layout pattern corresponding to each quantization level. When the first printing operation is employed for a relatively-large-size printing medium, graininess is suppressed, but density unevenness becomes noticeable, failing to reduce both density unevenness and graininess. To the contrary, when the second printing operation is employed, both density unevenness and graininess can be reduced. For a relatively-large-size printing medium, it is therefore preferable to use the second printing operation of performing printing using plural types of dot layout patterns as shown in FIG. 10C as a dot layout pattern corresponding to each quantization level.

From these examination results, the first printing operation is executed when the size of the printing medium used for printing is 4 inches or less. The second printing operation is executed when the size of the printing medium used for printing is larger than 4 inches. This can suppress both density unevenness and graininess in the main scanning and sub-scanning directions to acceptable levels. In other words, upon assigning different dot layout patterns corresponding to the printing medium size to respective pixels, one dot layout pattern (pattern as shown in FIG. 7C) is assigned to a plurality of pixels at the same quantization level for a relatively small printing medium size. For a relatively large printing medium size, different dot layout patterns (patterns as shown in FIG. 10C) are assigned to a plurality of pixels at the same quantization level. Both the density unevenness suppression effect and graininess suppression effect can be obtained regardless of the printing medium size.

The following printing control is executed in consideration of the above examination.

Figure 13:
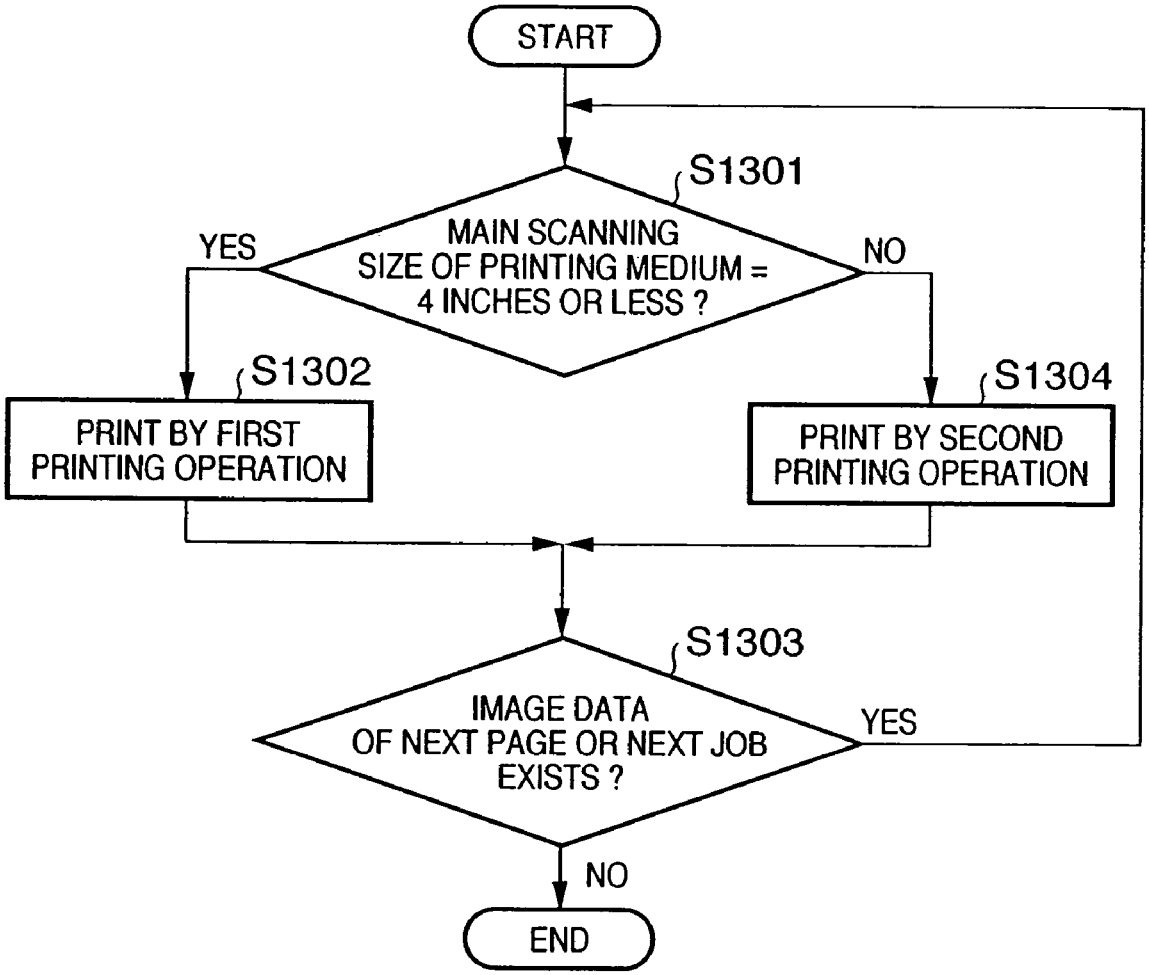
FIG. 13 is a flow chart showing printing control according to the first embodiment.

FIG. 13 is a flow chart showing printing control according to the first embodiment.

In step S1301, whether the main scanning size of the printing medium is 4 inches or less is determined on the basis of information on a printing medium size necessary for printing that is added to image data input to the image input unit 303.

If YES in step S1301, the processing advances to step S1302 to perform printing by the first printing operation, and then to step S1303. If NO in step S1301, the processing advances to step S1304 to perform printing by the second printing operation, and then to step S1303.

In step S1303, whether or not image data of the next page or next job exists is determined. If YES in step S1303, the processing returns to step S1301 to repeat the above-described processing; if NO, the processing ends.

According to the first embodiment described above, the ink droplet adhering position as a dot layout within each printing pixel on a printing medium is changed in accordance with the main scanning size of the printing medium. This results in printing a high-quality image in which density unevenness is sufficiently suppressed and graininess is visually reduced.

First Modification

In the second printing operation, unlike the first printing operation, the printing medium conveyance amount in the sub-scanning direction is changed every scan-printing. However, the present invention is not limited to this. For example, even in the second printing operation, the printing medium conveyance amount may be set equal to that in the first printing operation, and instead, the ink droplet discharge timing of the printhead may be changed in the main scanning direction in which the printhead is scanned.

FIGS. 14A to 14C are views for explaining a printing dot layout (ink droplet adhering position) pattern within each printing pixel on a printing medium when pixel data shown in FIG. 5 is printed with the same conveyance amount as that in the first printing operation by changing the ink droplet discharge timing of the printhead in the main scanning direction.

FIG. 14A shows 4-bit pixel data of bit data "a" to "d". FIG. 14B shows a state in which dots are laid out at an upper left position "a" and upper right position "b" when a lattice of 600×600 dpi is segmented into 2×2 lattices of 1,200×1, 200 dpi. FIG. 14C shows dots laid out at the positions "a" and "b" in accordance with the quantization level. In printing operation of a first modification, a dot layout pattern as shown in FIG. 14C corresponding to pixel quantization is assigned to each pixel.

As shown in FIG. 14C, quantization level 1 has two dot layout (ink droplet landing position) patterns, quantization level 2 has three dot layout patterns, quantization level 3 has four dot layout patterns, and quantization level 4 has five dot layout patterns.

Referring back to FIG. 6, in printing by the first scanning, a printing medium is conveyed in the sub-scanning direction by a conveyance amount of 2/600 inches corresponding to ¼ of the entire nozzle width of the printhead. Only data at the bit position "a" out of the pixel data in FIG. 14A is selected and printed using the orifices n7 and n8 of the printhead for the image region I. More specifically, the discharge timing of the printhead in the main scanning direction is a timing dischargeable at a resolution which is twice a resolution corresponding to ½ of a 600-dpi printing pixel in the main scanning direction. Printing is done in the forward direction along the main scanning direction while ink is discharged only at the first half of the discharge timing corresponding to ½ of the 600-dpi printing pixel in the main scanning direction. A printing dot is laid out and printed for each pixel at the position "a" in FIG. 14B.

In the second scanning, the printing medium P is conveyed in the sub-scanning direction by a conveyance amount of 2/600 inches. Only data at the bit position "b" out of the pixel data in FIG. 14A is selected and printed using the orifices n5 and n6 for the image region I and the orifices n7 and n8 for the image region II. More specifically, printing is done in the forward direction along the main scanning direction while ink is discharged to a position shifted from the dot printing position of the first scanning by 1/1200 inches in the main scanning direction at only the second half of the discharge timing corresponding to ½ of the 600-dpi printing pixel in the main scanning direction and a discharge timing different from that of the dot printing position in the first scanning. A printing dot is laid out and printed for each pixel at the position "b" in FIG. 14B.

In the third scanning, the printing medium P is conveyed in the sub-scanning direction by a conveyance amount of 2/600 inches. Only data at the bit position "c" out of the pixel data in FIG. 14A is selected and printed using the orifices n3 and n4 for the image region I, the orifices n5 and n6 for the image region II, and the orifices n7 and n8 for the image region III. More specifically, printing is done in the forward direction along the main scanning direction only at the first half of the discharge timing corresponding to ½ of the 600-dpi printing pixel in the main scanning direction and a timing at which ink is discharged to the same lattice point as in the first scanning. A printing dot is laid out and printed for each pixel at the position "a" in FIG. 14B.

In the fourth scanning, the printing medium P is conveyed in the sub-scanning direction by a conveyance amount of 2/600 inches. Only data at the bit position "d" out of the pixel data in FIG. 14A is selected and printed using the orifices n1 and n2 for the image region I, the orifices n3 and n4 for the image region II, the orifices n5 and n6 for the image region III, and the orifices n7 and n8 for the image region IV. More specifically, printing is done in the forward direction along the main scanning direction while ink is discharged at only the second half of the discharge timing corresponding to ½ of the 600-dpi printing pixel in the main scanning direction and the same timing as that in the second scanning. A printing dot is laid out and printed for each pixel at the position "b" in FIG. 14B.

Printing is performed in the fifth and subsequent scanning operations by the same method as that of the first to fourth scanning operations.

FIGS. 15A to 15D are views each showing the dot distribution of 2×2 printed pixels in correspondence with each quantization level according to the first modification.

Figure 15A:
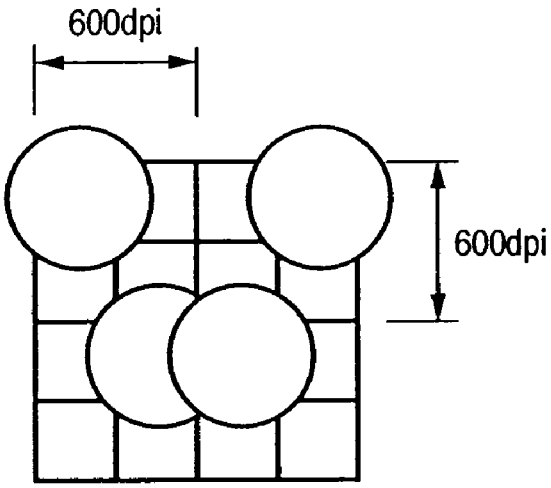
FIGS. 15A, 15B, 15C, and 15D are views each showing the dot distribution of 2×2 printed pixels at each quantization level according to the first modification to the first embodiment.
Figure 15B:
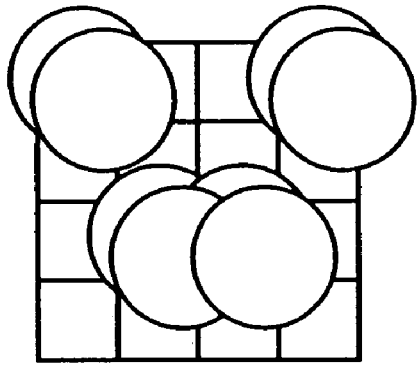
Figure 15C:
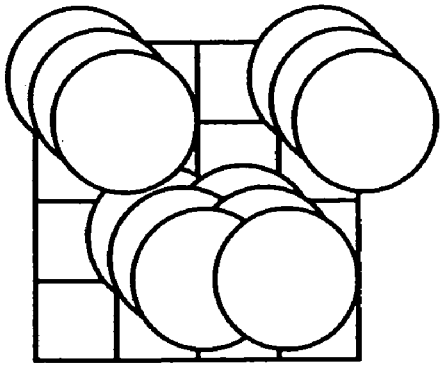
Figure 15D:
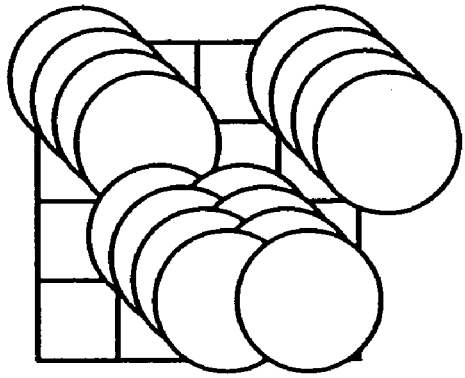

FIG. 15A shows quantization level 1, FIG. 15B shows quantization level 2, FIG. 15C shows quantization level 3, and FIG. 15D shows quantization level 4. From FIGS. 15A to 15D, dots are laid out at different intervals at any level. In these dot layouts, all upper left and lower right pixels are printed at the position "a" in FIG. 14B, and all upper right and lower left pixels are printed at the position "b" in FIG. 14B in a matrix of 2×2 pixels at 600×600 dpi shown in FIGS. 15A to 15D.

As apparent from a comparison of FIGS. 15A to 15D with FIGS. 11A to 11D, printing dots are laid out at different intervals in the sub-scanning direction in FIGS. 11A to 11D, but laid out at different intervals in the main scanning direction in FIGS. 15A to 15D.

In this way, the same effects can be obtained even when the ink droplet discharge timing of the printhead in the main scanning direction is changed in accordance with the main scanning size of the printing medium, similar to the case in which the printing medium conveyance amount is changed in accordance with the main scanning size of the printing medium.

Second Modification

In the first embodiment, the printing dot layout (ink droplet adhering position) within each printing pixel is changed in accordance with the main scanning size of the printing medium. However, the present invention is not limited to this. For example, the printing dot layout (ink droplet adhering position) within each printing pixel may be changed in accordance with the sub-scanning size of the printing medium. Alternatively, the printing dot layout (ink droplet adhering position) within each printing pixel may be changed in accordance with the sum of the main scanning and sub-scanning sizes of the printing medium.

FIG. 16 is a table showing the relationship among the sub-scanning size of the printing medium, density unevenness in the main scanning and sub-scanning directions, and graininess according to the second modification.

FIG. 16 shows image quality results obtained by printing while changing the printing dot layout within each printing pixel in accordance with the sub-scanning size of the printing medium.

FIG. 17 is a table showing the relationship among the sum of the main scanning and sub-scanning sizes of the printing medium, density unevenness in the main scanning and sub-scanning directions, and graininess according to the second modification.

FIG. 17 shows image quality results obtained by printing while changing the printing dot layout within each printing pixel in accordance with the sum of the main scanning and sub-scanning sizes of the printing medium.

Also in these cases, the same effects as those of the first embodiment can be obtained.

Second Embodiment

The second embodiment will exemplify a case in which the ink droplet adhering position within each printing pixel on a printing medium is changed in accordance with the printing size of image data to be printed.

In the following description, a description of the same parts as those in the first embodiment will be omitted, and only the characteristic features of the second embodiment will be mainly explained. A printhead adopted in the second embodiment is identical to one having the arrangement shown in FIG. 4. The quantization level of image data, the number of printing dots, and pixel data are also the same as those shown in FIG. 5. The first and second printing operations are the same as those shown in FIGS. 6 and 9. The printing dot layouts and the like are also the same as those shown in FIGS. 7A to 7C and 8A to 8D for the first printing operation, and those shown in FIGS. 10A to 10C and 11A to 11D for the second printing operation.

FIG. 18 is a table showing the relationship among the main scanning sizes of image data printed on printing media by the first and second printing operations, density unevenness in the main scanning and sub-scanning directions, and graininess.

In FIG. 18, the quality of a printed image is evaluated at five levels, similar to FIG. 12. "◎" means "excellent", "○" means "good", "Δ" means "fair", "x" means "not good", and "xx" means "bad".

In the first printing operation, density unevenness in the main scanning and sub-scanning directions exhibits good level when the main scanning size of the printing image is 4 inches or less. However, as the size increases, density unevenness becomes noticeable. As for graininess, since printing dots are laid out at the same interval at any quantization level, as shown in FIGS. 8A to 8D, the image quality is generally good. As the main scanning size of the printing image increases, the visual distance from the printing medium increases. Thus, graininess is further reduced for a larger main scanning size of the printing image.

In the second printing operation, density unevenness in the main scanning and sub-scanning directions exhibits good level regardless of the main scanning size of the printing image. To the contrary, graininess is slightly worse than that in the first printing operation because printing dots are laid out at different intervals at any quantization level, as shown in FIGS. 11A to 11D. In particular, as the main scanning size of the printing image decreases, the visual distance from a printing medium on which the image is printed decreases. Thus, graininess becomes conspicuous for a smaller size of the printing image.

As summarized, as for density unevenness, the second printing operation reduces periodic density unevenness in comparison with the first printing operation because noise is added by laying out printing dots at different intervals. However, as the main scanning size of the printing image decreases, the density unevenness period relatively increases. Even in the first printing operation, density unevenness hardly visually stands out when the size of the printing image is about 4 inches or less.

As for graininess, the second printing operation generates more graininess than the first printing operation because printing dots are laid out at different intervals. However, as the main scanning size of the printing image increases, the visual distance from a printing medium on which the image is printed increases, thereby reducing perceptible graininess. Even in the second printing operation, graininess hardly visually stands out when the size of the printing image is larger than 4 inches.

From these examination results, the first printing operation is executed when the main scanning size of the printing image is 4 inches or less. The second printing operation is executed when the main scanning size of the printing image is larger than 4 inches. This results in suppressing both density unevenness and graininess in the main scanning and sub-scanning directions. In other words, upon assigning different dot layout patterns corresponding to the image data size to respective pixels, one dot layout pattern (pattern as shown in FIG. 7C) is assigned to a plurality of pixels at the same quantization level for a relatively small image data size. For a relatively large image data size, different dot layout patterns (patterns as shown in FIG. 10C) are assigned to a plurality of pixels at the same quantization level. Therefore, both the density unevenness suppression effect and graininess suppression effect can be obtained regardless of the printing medium size.

Considering the above examination, the following printing control is executed.

Figure 19:
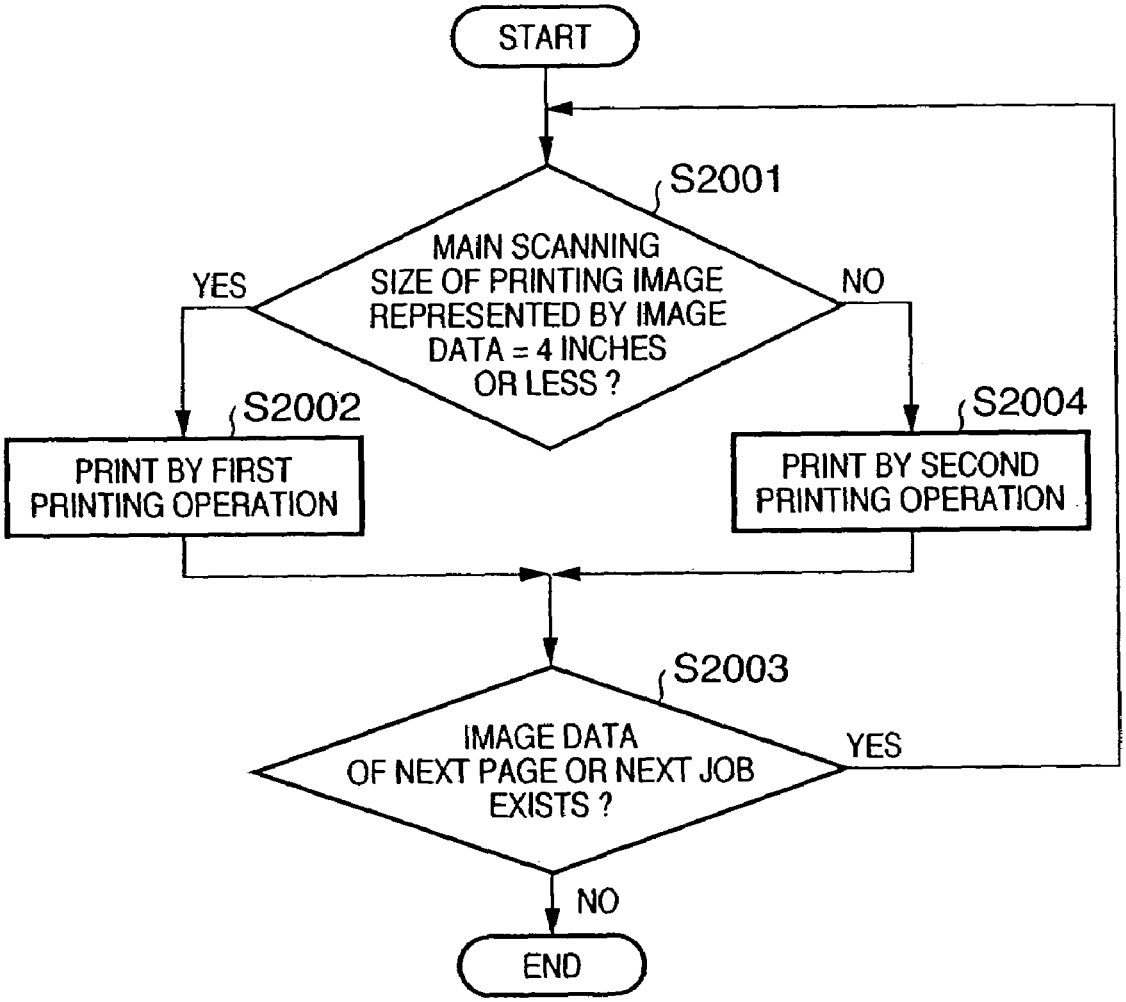
FIG. 19 is a flow chart showing printing control according to the second embodiment.

FIG. 19 is a flow chart showing printing control according to the second embodiment.

In step S2001, whether the maximum printing size of an image to be printed in the main scanning direction is 4 inches or less is determined on the basis of image data input to the image input unit 303.

If YES in step S2001, the processing advances to step S2002 to perform printing by the first printing operation, and then to step S2003. If NO in step S2001, the processing advances to step S2004 to print by the second printing operation, and then to step S2003.

In step S2003, whether or not image data of the next page or next job exists is determined. If YES in step S2003, the processing returns to step S2001 to repeat the above-described processing; if NO, the processing ends.

According to the second embodiment described above, the ink droplet adhering position as a dot layout within each printing pixel on a printing medium is changed in accordance with the main scanning size of an image to be printed on the basis of image data (i.e., the main scanning size of image data). This results in printing a high-quality image in which density unevenness is sufficiently suppressed and graininess is visually reduced.

Also in the second embodiment, the printing medium conveyance amount in the sub-scanning direction is changed every scan-printing in the second printing operation, unlike the first printing operation. Alternatively, even in the second printing operation, the printing medium conveyance amount may be set equal to that in the first printing operation, and the ink droplet discharge timing of the printhead may be changed in the main scanning direction in which the printhead is scanned.

In this embodiment, the printing dot layout (ink droplet adhering position) within each printing pixel is changed in accordance with the main scanning size of the printing image (main scanning size of image data). However, the present invention is not limited to this. For example, the printing dot layout (ink droplet adhering position) within each printing pixel may be changed in accordance with the sub-scanning size of the printing image. Alternatively, the printing dot layout (ink droplet adhering position) within each printing pixel may be changed in accordance with the sum of the main scanning and sub-scanning sizes of the printing image.

FIG. 20 is a table showing the relationship among the sub-scanning size of an image printed on a printing medium, density unevenness in the main scanning and sub-scanning directions, and graininess.

FIG. 20 shows image quality results obtained by printing while changing the printing dot layout within each printing pixel in accordance with the sub-scanning size of the printing medium.

FIG. 21 is a table showing the relationship among the sum of the main scanning and sub-scanning sizes of the printing image, density unevenness in the main scanning and sub-scanning directions, and graininess.

FIG. 21 shows image quality results obtained by printing while changing the printing dot layout within each printing pixel in accordance with the sum of the main scanning and sub-scanning sizes of the printing medium.

Also in these cases, the same effects as those of the second embodiment can be obtained.

OTHER EMBODIMENTS

The first and second embodiments adopt a method of comparing the printing medium size or image data size with a predetermined size and changing the dot layout pattern for use in accordance with the comparison result (in other words, a method of selecting, in accordance with the comparison result, one printing operation from a plurality of printing operations of printing with different dot layouts). However, the present invention is not limited to this. Such comparison processing can also be omitted by making a dot layout pattern for use (printing operation method for use) correspond to a printing medium size or image data size in advance without comparing the printing medium size or image data size with a predetermined size.

For example, as shown in Table 1, a table which makes information on the printing medium size and a dot layout pattern for use correspond to each other may be prepared in advance. Upon printing, information on the printing medium size is acquired, and a dot layout pattern corresponding to the acquired information is used. The table may be one which makes information on the image data size and a dot layout pattern for use correspond to each other, or one which makes information on the image data size, information on the printing medium size, and a dot layout pattern for use correspond to each other.

TABLE 1

| Information on Printing Medium Size | Dot Layout Pattern For Use |
|---|---|
| 3 inches | Pattern in FIG. 7C |
| 4 inches | Pattern in FIG. 7C |
| 5 inches | Pattern in FIG. 10C |
| 6 inches | Pattern in FIG. 10C |
| 7 inches | Pattern in FIG. 10C |
| 8 inches | Pattern in FIG. 10C |

In the above embodiments, the size value such as 3 inches, 4 inches, or X inches is used as information on the printing medium size or information on the image data size. However, the present invention is not limited to this. Information suffices to correspond to the printing medium size or image data size, and may be information which indirectly represents the printing medium size or image data size. For example, the size information may be represented by 4-bit data such that "0000" is defined as 3 inches, "0001" is defined as 4 inches, and "0010" is defined as 5 inches. Such information which indirectly represents the printing medium size or image data size may be employed. As for image data, the number of bits of image data and size information can also be made to correspond to each other.

As described above, according to the present invention, information suffices to be information on the printing medium size and/or information on the image data size, and may be information which directly or indirectly represents the size.

In the above embodiments, either the first printing operation mode in which one dot layout pattern (e.g., dot layout pattern as shown in FIG. 7C) is assigned to pixels at the same level in which the same number of dots are printed, or the second printing operation mode in which plural types of dot layout patterns (e.g., dot layout patterns as shown in FIG. 10C) are assigned to pixels at the same level in which the same number of dots are printed is selected on the basis of at least either one of information on the printing medium size and information on the image data size. However, the present invention is not limited to this. For example, these printing modes may be arbitrarily selected by the user. In this case, the mode may be selected by a switch attached to the operation unit 306 of the printing apparatus. Alternatively, the mode may be selected on property selection screen of a printer driver installed in a host computer connected to the printing apparatus.

The printhead used in the two embodiments described above has eight orifices at a resolution of 600 dpi in the sub-scanning direction, but the present invention is not limited to this. For example, the resolution may be 1,200 dpi or another density, and the number of orifices may be 64, 128, or 256 other than eight. Further, the orifice layout is not limited to one as shown in FIG. 4.

Figure 22:
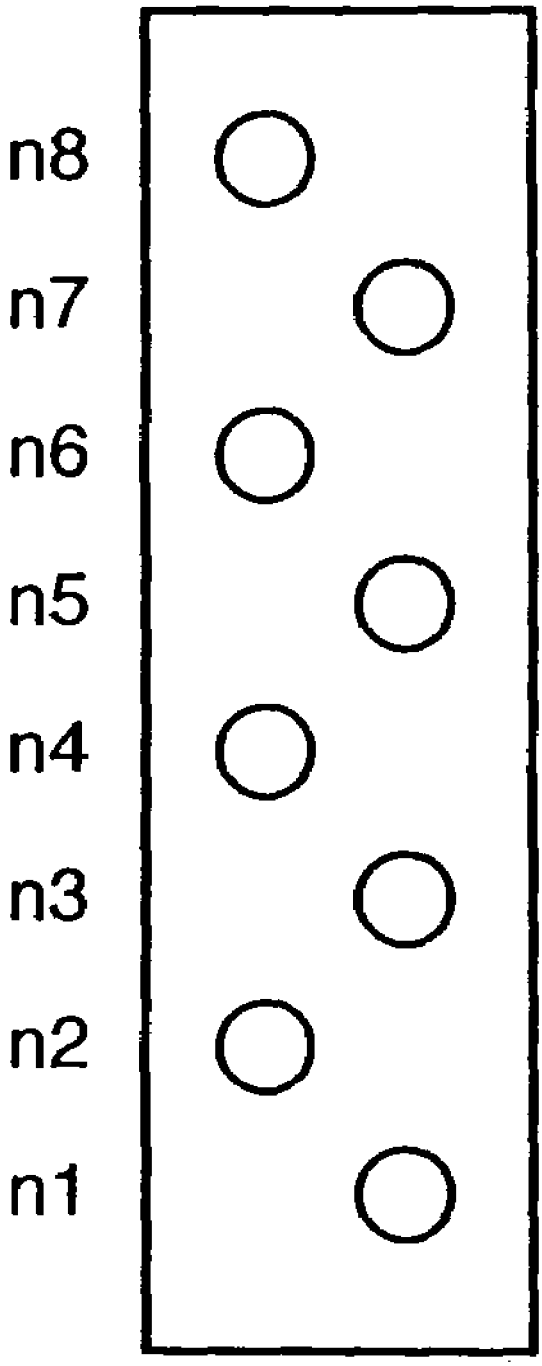
FIG. 22 is a view showing a modification to the orifice layout of the printhead.

FIG. 22 is a view showing a modification to the orifice layout of the printhead.

As shown in FIG. 22, orifices may be staggered instead of a linear layout.

The size of an ink droplet discharged from each ink orifice is about 5 pl in the above embodiments, but the present invention is not limited to this. For example, the ink droplet size may be as small as about 2 pl, or as large as about 10 pl. For a discharge ink droplet volume of about 2 pl, image data may be 8-bit data at a resolution of 600×600 dpi per pixel and quantized to nine levels from 0 to 8.

In the above embodiments, one of plural types of pixel data is selected at random at a quantization level corresponding to pixel data at which a plurality of bit patterns exist, as shown in FIG. 5. However, the present invention is not limited to this, and pixel data may be regularly selected.

The embodiments have described printing operation by referring to only one printhead. The present invention can also be applied to four printheads which print in color using four, K, C, M, and Y inks, as shown in FIG. 1, obtaining the same effects as those described above.

In the above embodiments, droplets discharged from the printhead are ink droplets, and liquid stored in the ink tank is ink. However, the liquid to be stored in the ink tank is not limited to ink. For example, processing liquid or the like to be discharged onto a print medium so as to improve the fixing property or water repellency of a printed image or its image quality may be contained in the ink tank.

Of inkjet printing methods, the above embodiments preferably employ a method in which means (e.g., an electrothermal transducer or laser beam) for generating thermal energy as energy used to discharge ink is adopted and the ink state is changed by thermal energy.

As many apparently widely different embodiments of the present invention can be made without departing from the spirit and scope thereof, it is to be understood that the invention is not limited to the specific embodiments thereof except as defined in the appended claims.

What is claimed is:

1. A printing method of printing by discharging ink from a printhead onto a printing medium on the basis of a dot layout pattern corresponding to a gradation level of each pixel, comprising:

a selection step of selecting one printing operation mode from a first printing operation mode in which one dot layout pattern is assigned to a plurality of pixels at a predetermined gradation level from among a plurality of gradation levels and printing is done on the basis of the assigned dot layout pattern, and a second printing operation mode in which plural types of dot layout patterns are assigned to a plurality of pixels at the predetermined gradation level and printing is done on the basis of the assigned dot layout patterns; and a printing step of executing the printing operation mode selected in said selection step.

2. A printing method of printing by discharging ink from a printhead onto a printing medium, comprising:

a determination step of determining a dot layout pattern to be assigned to each pixel in accordance with at least one item of information from among information on a size of the printing medium and information on a size of image data; and a printing step of printing each pixel on the basis of the determined dot layout pattern, wherein said determination step determines whether to assign one dot layout pattern or plural types of dot layout patterns to a plurality of pixels at a predetermined level in which a predetermined number of dots are printed in accordance with the at least one item of information.

3. The method according to claim 2, wherein the one dot layout pattern assigned to the pixels at the predetermined level includes a pattern for printing one or more dots at the same position within the pixel, and the plural types of dot layout patterns assigned to the pixels at the predetermined level include a pattern for printing dots at different positions within the pixel.

4. The method according to claim 2, wherein the plural types of dot layout patterns assigned to the pixels at the predetermined level include a pattern for printing dots at different positions within the pixel, and a pattern for printing dots at the same position within the pixel.

5. A printing apparatus which prints by discharging ink from a printhead onto a printing medium on the basis of a dot layout pattern corresponding to a gradation level of each pixel, comprising:

first printing means for executing a first printing operation mode in which one dot layout pattern is assigned to a plurality of pixels at a same gradation level and printing is done on the basis of the assigned dot layout pattern;

second printing means for executing a second printing operation mode in which plural types of dot layout patterns are assigned to a plurality of pixels at the same gradation level and printing is done on the basis of the assigned dot layout patterns; and determining means for determining whether the first printing operation mode or the second printing operation mode is to be executed, based on information on a size of the printing medium.

6. A printing apparatus which prints by discharging ink from a printhead onto a printing medium on the basis of a dot layout pattern corresponding to a gradation level of each pixel, comprising:

first printing means for executing a first printing operation mode in which one dot layout pattern is assigned to a pixel corresponding to a predetermined gradation level from among a plurality of gradation levels and printing is done on the basis of the assigned dot layout pattern;

second printing means for executing a second printing operation mode in which plural types of dot layout patterns are assigned to a pixel corresponding to the predetermined gradation level and printing is done on the basis of the assigned dot layout patterns; and determining means for determining whether the first printing operation mode or the second printing operation mode is to be executed, based on information on a size of the printing medium.

7. A printing apparatus which prints by discharging ink from a printhead onto a printing medium, comprising:

first printing means for executing a first printing operation mode in which a dot layout pattern for printing dots at the same position within a pixel is assigned to a pixel corresponding to a predetermined gradation level from among a plurality of gradation levels and printing is done on the basis of the assigned dot layout pattern;

second printing means for executing a second printing operation mode in which plural types of dot layout patterns including a dot layout pattern for printing dots at different positions within the pixel and a pattern for printing dots at the same position within the pixel are assigned to a pixel corresponding to the predetermined gradation level and printing is done on the basis of the assigned dot layout patterns; and determining means for determining whether the first printing operation mode or the second printing operation mode is to be executed.

8. A printing apparatus which prints by discharging ink from a printhead onto a printing medium, comprising:

determination means for determining a dot layout pattern to be assigned to each pixel in accordance with at least one item of information from among information on a size of the printing medium and information on a size of image data; and printing means for printing each pixel on the basis of the dot layout pattern determined by said determination means, wherein said determination means determines, in accordance with the at least one item of information, whether to assign one dot layout pattern or plural types of dot layout patterns to a plurality of pixels at a predetermined level in which a predetermined number of dots are printed.

9. The apparatus according to claim 8, further comprising:

scanning means for reciprocally scanning the printhead in a first direction; and conveyance means for conveying the printing medium in a second direction different from the first direction, wherein the size of the printing medium includes any one of a size in the first direction, a size in the second direction, and a sum of the sizes in the first and second directions, and the size of the image data includes any one of a size in the first direction, a size in the second direction, and a sum of the sizes in the first and second directions.

10. The apparatus according to claim 9, wherein said printing means includes multi-pass printing control means for controlling so as to scan a region printable by one scanning using all printing elements of the printhead by the printhead a plurality of number of times, thereby completing printing in the region.

11. The apparatus according to claim 9, wherein the one dot layout pattern assigned to the pixels at the predetermined level includes a pattern for printing dots at the same position within the pixel, and the plural types of dot layout patterns assigned to the pixels at the predetermined level include a pattern for printing dots at different positions within the pixel.

12. The apparatus according to claim 11, wherein the plural types of dot layout patterns assigned to the pixels at the predetermined level include a pattern for printing dots at different positions within the pixel, and a pattern for printing dots at the same position within the pixel.

13. The apparatus according to claim 11, wherein in printing the pattern for printing dots at different positions within the pixel, dots are printed at the different positions by changing a dot position in the first direction in which the printhead is scanned by said scanning means.

14. The apparatus according to claim 11, wherein in printing the pattern for printing dots at different positions within the pixel, ink droplets are printed at the different positions by changing a dot position in the second direction in which the printing medium is conveyed by said conveyance means.

* * * * *

UNITED STATES PATENT AND TRADEMARK OFFICE

CERTIFICATE OF CORRECTION

PATENT NO. : 7,185,964 B2
APPLICATION NO. : 10/784262
DATED : March 6, 2007
INVENTOR(S) : Kanda et al.

It is certified that error appears in the above-identified patent and that said Letters Patent is hereby corrected as shown below:

COLUMN 8:
Line 48, “More.” should read --More--.

COLUMN 18:
Line 35, “dot” should read --the dot--.
Line 39, “dot” should read --the dot--.
Line 48, “property” should read --a property--.

Signed and Sealed this

Twenty-seventh Day of January, 2009

JOHN DOLL
*Acting Director of the United States Patent and Trademark Office*